US011219260B2

(12) United States Patent
Lotti

(10) Patent No.: US 11,219,260 B2
(45) **Date of Patent: *Jan. 11, 2022**

(54) ARTIFICIAL LASH EXTENSIONS

(71) Applicant: Lashify, Inc., Los Angeles, CA (US)

(72) Inventor: Sahara Lotti, Los Angeles, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/003,853

(22) Filed: Aug. 26, 2020

(65) Prior Publication Data

US 2020/0390175 A1 Dec. 17, 2020

Related U.S. Application Data

(63) Continuation of application No. 16/556,518, filed on Aug. 30, 2019, which is a continuation of application No. 15/968,361, filed on May 1, 2018, now Pat. No. 10,660,388, which is a continuation of application No. PCT/US2017/044217, filed on Jul. 27, 2017.

(60) Provisional application No. 62/368,116, filed on Jul. 28, 2016.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | |
|---|---|---|---|
| 994,619 | A | 6/1911 | Taylor |
| 1,021,063 | A | 3/1912 | Miller |
| 1,450,259 | A | 4/1923 | Charles |
| 1,831,801 | A | 11/1931 | Birk |
| 1,897,747 | A | 2/1933 | Birk |
| 2,013,011 | A | 9/1935 | Sheldon |
| D101,791 | S | 11/1936 | Rauh |
| D129,526 | S | 9/1941 | Hanisch |
| 2,268,082 | A | 12/1941 | , Sr. |

(Continued)

FOREIGN PATENT DOCUMENTS

| | | |
|---|---|---|
| CN | 102975141 | 3/2013 |
| CN | 103027410 A | 4/2013 |

(Continued)

OTHER PUBLICATIONS

"Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu . . . , downloaded from internet Oct. 10, 2018 (3 pages)."

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

An artificial lash extension system includes lash extensions designed for an application under a natural lash. Each of the lash extensions includes clusters of artificial hairs. Each of the clusters includes at least two artificial hairs and a base from which the at least two artificial hairs of each of the clusters protrude. Each of the lash extensions is formed by at least an application of heat at a respective base.

36 Claims, 10 Drawing Sheets

(56) References Cited

U.S. PATENT DOCUMENTS 2,323,595 A 7/1943 Arthur
2,392,694 A 1/1946 Rector
D154,227 S 6/1949 Alvizua
D155,559 S 10/1949 Tillmann
2,618,279 A 11/1952 Reiffert
2,812,768 A 11/1957 Giuliano
3,016,059 A 1/1962 Hutton
3,032,042 A 5/1962 Borg
3,174,321 A 3/1965 Williams
3,245,416 A 4/1966 Aylott
3,295,534 A 1/1967 Jess
3,343,552 A 9/1967 Steffen
3,392,727 A 7/1968 Hanlon
3,447,540 A * 6/1969 Osher ..... B29C 69/003 132/201
3,454,015 A 7/1969 Udes
3,478,754 A 11/1969 Martin, Jr.
3,547,135 A 12/1970 Roos
3,557,653 A 1/1971 Kim
3,561,454 A 2/1971 Oconnell
3,625,229 A 12/1971 Silson
3,645,281 A * 2/1972 Seidler ..... B65D 75/28 132/333
3,670,742 A 6/1972 Weaner
3,703,180 A 11/1972 Aylott
3,828,803 A 8/1974 Windsor
3,833,007 A * 9/1974 Jacobs ..... A41G 5/02 132/53
3,900,038 A 8/1975 Masters
D240,769 S 7/1976 Bowmann
3,968,807 A 7/1976 Kraicer
3,970,092 A 7/1976 Nelson
3,970,992 A 7/1976 Boothroyd et al.
3,971,392 A 7/1976 Brehmer
3,980,092 A 9/1976 Garufi
4,016,889 A 4/1977 Cowles
4,029,111 A 6/1977 Barton
4,049,006 A 9/1977 Saunders et al.
1,163,535 A 8/1979 Austin
4,168,713 A 9/1979 Agiotis
4,203,518 A 5/1980 Current
4,205,693 A 6/1980 Mallouf
4,225,693 A 9/1980 McCormick
4,254,772 A 3/1981 McNamee
4,254,784 A 3/1981 Nelson
4,284,092 A 8/1981 Auretta
4,296,765 A 10/1981 Bachtell
D261,601 S 11/1981 Kettlestrings
4,299,242 A * 11/1981 Choe ..... A41G 5/02 132/53
4,360,033 A 11/1982 Schmehling
4,395,824 A 8/1983 Puro
D270,551 S 9/1983 Thayer
4,458,701 A 7/1984 Holland
4,509,539 A 4/1985 Alfieri
D280,354 S 8/1985 Bakic
D281,259 S 11/1985 Hensley
D281,825 S 12/1985 Bakic
4,600,029 A 7/1986 Ueberschaar
4,697,856 A 10/1987 Abraham
4,739,777 A 4/1988 Nelson
D298,070 S 10/1988 Ferrari
4,784,713 A 11/1988 Van Nieulande
D299,561 S 1/1989 Bakic
D301,371 S 5/1989 Kaprelian
D302,602 S 8/1989 Bakic
4,865,057 A 9/1989 Braun
4,934,387 A 6/1990 Megna
4,964,428 A 10/1990 Lamatrice
D314,066 S 1/1991 Bakic
5,010,914 A 4/1991 Merges
D318,346 S 7/1991 Bakic
5,033,626 A 7/1991 Platti
5,072,745 A 12/1991 Cheh
5,082,010 A 1/1992 Skaryd et al.
5,117,846 A 6/1992 Finamore et al.
D328,246 S 7/1992 Nottingham et al.
5,154,195 A 10/1992 Irisawa
D342,671 S 12/1993 Elliott
D343,340 S 1/1994 Frye, Jr. et al.
5,307,826 A 5/1994 Iosilevich
D348,219 S 6/1994 Goldberg
5,322,166 A 6/1994 Crowther
5,368,052 A 11/1994 Finamore
5,377,700 A 1/1995 Harris
D358,312 S 5/1995 Keenan
5,411,775 A 5/1995 Wilson
5,419,345 A 5/1995 Kadymir
D359,583 S 6/1995 Abbo
D368,495 S 4/1996 Rypinski
5,533,529 A 7/1996 Ohno
5,547,529 A 8/1996 Woolf
D373,726 S 9/1996 Power
5,571,543 A 11/1996 Song et al.
D379,923 S 6/1997 De Baschmakoff
D380,616 S 7/1997 Leslie et al.
D382,198 S 8/1997 Mulhauser et al.
D386,808 S 11/1997 Litton
D387,483 S 12/1997 Sloan
D388,549 S 12/1997 Mouyiaris et al.
5,746,232 A 5/1998 Martin et al.
5,765,571 A 6/1998 Dinnel
D397,040 S 8/1998 Bakic
5,813,418 A 9/1998 Pillars
D403,922 S 1/1999 Terracciano et al.
D404,531 S 1/1999 Bakic et al.
5,894,846 A 4/1999 Gang
5,896,996 A 4/1999 Chuang
D411,649 S 6/1999 Bakic
D418,018 S 12/1999 Winsted
D418,253 S 12/1999 Bakic
6,003,467 A 12/1999 Shelton-Ferrell et al.
6,016,814 A 1/2000 Elliott
6,019,107 A 2/2000 Overmyer et al.
6,029,674 A 2/2000 Han
6,032,609 A 3/2000 Luoma
6,035,861 A 3/2000 Copello
6,092,291 A 7/2000 Cendoma
6,109,274 A 8/2000 Ingersoll
D437,086 S 1/2001 Dickert
6,174,321 B1 1/2001 Webb
6,182,839 B1 2/2001 Robbins et al.
D442,304 S 5/2001 Huang
6,230,715 B1 5/2001 Cho
D443,471 S 6/2001 Lillelund et al.
6,247,476 B1 6/2001 Sartena
6,257,250 B1 7/2001 Sartena
6,265,010 B1 7/2001 Franco
D448,927 S 10/2001 Vazquez
6,302,115 B1 10/2001 Sartena
6,308,716 B1 10/2001 Han
D452,151 S 12/2001 Scott
D454,981 S 3/2002 Lamagna et al.
D456,077 S 4/2002 Etter et al.
D456,097 S 4/2002 LaMagna et al.
D458,413 S 6/2002 Boilen
6,405,736 B2 6/2002 Townsend
6,439,406 B1 8/2002 Duhon
D463,280 S 9/2002 Brozell
D463,744 S 10/2002 Brozell
D464,565 S 10/2002 Weinstein et al.
D464,877 S 10/2002 Weinstein et al.
6,471,515 B2 10/2002 Feuer
D467,800 S 12/2002 Chen et al.
6,494,212 B1 12/2002 Yamakoshi
6,530,379 B2 3/2003 Iosilevich
D472,675 S 4/2003 Lamagna
D472,810 S 4/2003 Gelardi et al.
D473,106 S 4/2003 Scherer
6,561,197 B2 5/2003 Harrison
D475,616 S 6/2003 Lambrecht
6,581,609 B2 6/2003 Ott
D479,365 S 9/2003 Todeschini
D480,864 S 10/2003 Sayers et al.

(56) References Cited

U.S. PATENT DOCUMENTS

D481,946 S 11/2003 Nicholson et al.
D481,952 S 11/2003 Orsomando
D482,495 S 11/2003 Jackel-Marken
D482,928 S 12/2003 Liu
D482,934 S 12/2003 Liu
D483,232 S 12/2003 Liu
D483,633 S 12/2003 Jansson
D483,909 S 12/2003 Todeschini
D485,359 S 1/2004 McMichael et al.
6,688,315 B1 2/2004 Harrison
6,691,714 B1 2/2004 Yaguchi et al.
6,708,696 B2 3/2004 Ferguson
D488,353 S 4/2004 Govrik et al.
D488,618 S 4/2004 Wekstein
D490,932 S 6/2004 Mammone
D491,336 S 6/2004 Cecere
D495,834 S 9/2004 Fodeschini
D496,759 S 9/2004 Rodriguez
6,820,625 B2 11/2004 Park
D501,580 S 2/2005 Sugawara
D506,573 S 6/2005 de Grandcourt
D507,678 S 7/2005 Lamagna
6,935,348 B2 8/2005 Gold
6,935,349 B2 8/2005 Nicot et al.
D509,942 S 9/2005 Connolly et al.
D512,913 S 12/2005 Gauthier
6,973,931 B1 12/2005 King
6,981,814 B2 1/2006 Geardino et al.
D515,242 S 2/2006 Cho
D516,247 S 2/2006 Merheje
7,000,775 B2 2/2006 Gelardi et al.
7,036,518 B2 5/2006 Park
D522,376 S 6/2006 Hales
D532,891 S 11/2006 Buthier et al.
D533,650 S 12/2006 Ohta
D534,426 S 1/2007 Bakic
7,159,720 B2 1/2007 Pearson
7,168,432 B1 1/2007 Brumfield
D537,208 S 2/2007 Shaljian
D540,112 S 4/2007 Nichols et al.
D543,662 S 5/2007 Bivona et al.
D543,815 S 6/2007 Metcalf
D543,850 S 6/2007 Legros
D544,148 S 6/2007 Bivona et al.
D544,202 S 6/2007 Markfelder
D545,396 S 6/2007 Casey et al.
7,228,863 B2 6/2007 Dumler et al.
D546,002 S 7/2007 Bowen
D547,940 S 8/2007 Sandy
D559,457 S 1/2008 Garland et al.
D561,045 S 2/2008 Lee
D561,942 S 2/2008 Khubani
7,331,351 B1 2/2008 Asai
D563,157 S 3/2008 Bouveret et al.
D563,616 S 3/2008 Lynde et al.
D563,728 S 3/2008 Welch, III
7,343,921 B2 3/2008 Salinas
D569,041 S 5/2008 Azoulay
D569,553 S 5/2008 Cho
7,374,048 B2 5/2008 Mazurek
D571,543 S 6/2008 Sungadi
D573,308 S 7/2008 Wittke-Kothe
D575,904 S 8/2008 Iqbal
D579,059 S 10/2008 Chan
7,469,701 B1 12/2008 Bernard
D584,449 S 1/2009 Shaljian
D587,529 S 3/2009 Pratt
D588,746 S 3/2009 Ross
D591,599 S 5/2009 Okin et al.
D592,923 S 5/2009 Konopka
7,533,676 B2 5/2009 Sthair
D595,054 S 6/2009 Whitaker
D600,441 S 9/2009 Estrada
D602,354 S 10/2009 Dibnah et al.
7,600,519 B2 10/2009 Dinh
D604,579 S 11/2009 Robinson et al.
7,610,921 B2 11/2009 Gold
D605,514 S 12/2009 Weber
D607,332 S 1/2010 Huntington et al.
D615,290 S 5/2010 Heffner
D617,187 S 6/2010 Murray
D617,943 S 6/2010 Bouix et al.
D618,078 S 6/2010 Cripps
7,748,391 B2 7/2010 Vance
D627,103 S 11/2010 Cho
7,836,899 B2 11/2010 Sugai et al.
D631,606 S 1/2011 Chen
7,896,192 B2 3/2011 Conley et al.
D638,733 S 5/2011 Sullivan et al.
7,938,128 B2 5/2011 Gueret
D639,196 S 6/2011 Sullivan et al.
D640,005 S 6/2011 Lee et al.
D640,834 S 6/2011 Chen
D641,106 S 7/2011 Williams et al.
8,015,980 B2 9/2011 Rabe et al.
8,025,065 B2 9/2011 Guliker
8,042,553 B2 10/2011 Paris
D647,799 S 11/2011 Dunwoody
8,061,367 B2 11/2011 Rabe et al.
D650,669 S 12/2011 Dunwoody
D650,670 S 12/2011 Dunwoody
D651,082 S 12/2011 Dunwoody
8,113,218 B2 2/2012 Nguyen
8,127,774 B2 3/2012 Dinh
D657,496 S 4/2012 Flatt
D657,696 S 4/2012 Floyd et al.
D659,330 S 5/2012 Davis
8,171,943 B2 5/2012 Hamano
8,186,361 B2 5/2012 Hampton
D661,185 S 6/2012 Battat
D661,599 S 6/2012 Floyd et al.
8,191,556 B2 6/2012 Betts
8,196,591 B2 6/2012 Lee et al.
8,205,761 B2 6/2012 Stull, Sr. et al.
D663,113 S 7/2012 Simms
D664,011 S 7/2012 Affonso
8,225,800 B2 7/2012 Byrne
D669,223 S 10/2012 Lee et al.
D670,030 S 10/2012 Nguyen
D673,325 S 12/2012 Martines
8,342,186 B2 1/2013 Freelove
8,347,896 B2 1/2013 Liao
D679,590 S 4/2013 Stull, Sr. et al.
D679,591 S 4/2013 Stull, Sr. et al.
D679,592 S 4/2013 Stull, Sr. et al.
D679,595 S 4/2013 Stull, Sr. et al.
D679,596 S 4/2013 Stull, Sr. et al.
D682,103 S 5/2013 Jedlicka et al.
D682,688 S 5/2013 Murray
8,434,500 B2 5/2013 Alex
D686,495 S 7/2013 Murray
D690,419 S 9/2013 Porat
8,528,571 B2 9/2013 Costa
8,567,640 B1 10/2013 Johnson-Lofton
8,578,946 B2 11/2013 Ellery
8,596,284 B2 12/2013 Byrne
8,616,223 B2 12/2013 Rabe et al.
D698,078 S 1/2014 Purizhansky et al.
8,657,170 B2 2/2014 Martinez
D700,799 S 3/2014 Ludeman et al.
D702,510 S 4/2014 Segal
8,701,685 B2 4/2014 Chipman
D707,392 S 6/2014 Yu et al.
D707,556 S 6/2014 Kawamura
8,739,803 B2 6/2014 Freelove
8,752,562 B2 6/2014 Dinh
D709,129 S 7/2014 Moertl
D711,227 S 8/2014 Sheikh
D713,217 S 9/2014 Micara-Sartori et al.
D714,494 S 9/2014 Vasquez et al.
8,826,919 B2 9/2014 Dinh
D716,498 S 10/2014 Wolff
D717,038 S 11/2014 Lee
8,875,718 B2 11/2014 Dinh

(56) References Cited

U.S. PATENT DOCUMENTS 8,881,741 B1 11/2014 Mattson et al.
8,881,744 B2 11/2014 McKinstry
D718,901 S 12/2014 Parker
8,939,159 B2 1/2015 Yeo et al.
8,967,158 B2 3/2015 Sanbonmatsu
9,004,299 B2 4/2015 Hardin
9,027,568 B2 5/2015 Lee
9,044,076 B2 6/2015 Temple
9,078,480 B2 7/2015 Beschta
9,107,461 B2 8/2015 Martins et al.
D738,579 S 9/2015 Owens et al.
D738,611 S 9/2015 Gupta
9,149,083 B1 10/2015 Dinh
9,155,345 B2 10/2015 Nisim et al.
9,179,722 B2 11/2015 Le
D746,046 S 12/2015 Lee
D746,514 S 12/2015 Lambridis et al.
9,215,901 B1 12/2015 Schroeder
9,254,012 B2 2/2016 Pham
D751,904 S 3/2016 Landrum et al.
9,277,777 B2 3/2016 Lee et al.
D753,455 S 4/2016 Hyma
D753,881 S 4/2016 Hussain et al.
9,314,085 B2 4/2016 Hatch
D755,577 S 5/2016 Segal
D757,274 S 5/2016 Gelb et al.
D758,009 S 5/2016 Berkos
9,339,072 B2 5/2016 Kenna
9,351,752 B2 5/2016 Slavin
D761,489 S 7/2016 Krakovszki
D762,433 S 8/2016 Yang
D764,688 S 8/2016 Robinson et al.
D765,909 S 9/2016 Marchica et al.
9,439,465 B2 9/2016 Ott
9,451,800 B2 9/2016 Dinh
9,456,646 B2 10/2016 Calina
9,462,837 B2 10/2016 Ngo
9,468,245 B2 10/2016 Woods
9,486,025 B1 11/2016 Dinh
9,504,285 B2 11/2016 Lin
D773,915 S 12/2016 Barakat et al.
D775,270 S 12/2016 Moffat
9,516,908 B2 12/2016 Miyatake et al.
9,565,883 B2 2/2017 Dinh
9,596,898 B2 3/2017 Seawright
D783,899 S 4/2017 Roh
D783,901 S 4/2017 Kim et al.
D784,615 S 4/2017 Choi
9,622,527 B2 4/2017 Nguyen
D788,556 S 6/2017 James
9,730,481 B2 8/2017 Uresti
D796,582 S 9/2017 Beard
D800,966 S 10/2017 Silva
D805,135 S 12/2017 Beard
D806,315 S 12/2017 Hardwick
9,833,028 B2 12/2017 Jang et al.
9,848,661 B2 12/2017 Harris et al.
9,848,662 B2 12/2017 Dinh
D810,534 S 2/2018 Liu
D810,543 S 2/2018 Astradsson et al.
D811,872 S 3/2018 Wu
D814,107 S 3/2018 Lotti et al.
D814,260 S 4/2018 Dhubb
9,930,919 B1 4/2018 Branker et al.
D817,132 S 5/2018 Yang
9,993,373 B2 6/2018 Nassif et al.
D823,538 S 7/2018 Ruggaber
D823,683 S 7/2018 Caldwell
D825,333 S 8/2018 Ozamiz et al.
D828,013 S 9/2018 Van Wijngaarden et al.
D828,014 S 9/2018 Van Wijngaarden et al.
D828,629 S 9/2018 Hussain
D829,381 S 9/2018 Kim
D830,170 S 10/2018 Holmes
D832,701 S 11/2018 Oates
D832,702 S 11/2018 Oates
D835,465 S 12/2018 Son et al.
D836,432 S 12/2018 Riedel et al.
10,149,528 B2 12/2018 Erickson et al.
D836,943 S 1/2019 Klieman
D837,653 S 1/2019 Meranus
D840,104 S 2/2019 Hussain et al.
10,264,837 B2 4/2019 Park
D847,631 S 5/2019 Villbrandt
D847,632 S 5/2019 Villbrandt
D848,795 S 5/2019 Butler
D850,715 S 6/2019 Lotti
D852,412 S 6/2019 Grund et al.
10,362,823 B1 7/2019 Hill et al.
D863,419 S 10/2019 Oguma et al.
D863,679 S 10/2019 Lotti
10,433,607 B2 10/2019 Ahn
D867,664 S 11/2019 Lotti
D867,668 S 11/2019 Lotti
10,479,566 B2 11/2019 Doyle et al.
D871,673 S 12/2019 Qureshi et al.
10,532,861 B2 1/2020 Kimmel et al.
D877,416 S 3/2020 Lotti
10,660,388 B2 5/2020 Lotti
D890,430 S 7/2020 Lotti
10,721,984 B2 7/2020 Lotti
D895,201 S 9/2020 Lotti
D895,958 S 9/2020 Guo et al.
D909,680 S 2/2021 Hussain et al.
D914,965 S 3/2021 Lotti
D917,153 S 4/2021 Denei et al.
D918,475 S 5/2021 Hu
D920,400 S 5/2021 Saito
D920,465 S 5/2021 Bould et al.
D930,788 S 9/2021 Roth
D932,101 S 9/2021 Davis et al.
2001/0035192 A1 4/2001 Townsend
2001/0023699 A1 9/2001 Matthews
2001/0037813 A1 11/2001 Ra
2002/0056465 A1 5/2002 Shin
2002/0094507 A1 7/2002 Feuer
2002/0114657 A1 8/2002 Gueret
2002/0198597 A1 12/2002 Godfrey
2003/0005941 A1* 1/2003 Iosilevich ..... A41G 5/02 132/53
2003/0111467 A1 6/2003 Norman et al.
2003/0155317 A1 8/2003 McNeeley et al.
2003/0226571 A1 12/2003 Rahman
2004/0011371 A1 1/2004 Harrison
2004/0011372 A1 1/2004 Park
2004/0211436 A1 10/2004 Knight
2005/0061341 A1* 3/2005 Choe ..... A41G 5/02 132/53
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe et al.
2006/0129187 A1 6/2006 Cho
2006/0142693 A1 6/2006 Kahen
2006/0175853 A1 8/2006 Anderson et al.
2006/0180168 A1 8/2006 Dinnel
2006/0180171 A1 8/2006 Kim
2006/0266376 A1 11/2006 Basso
2007/0023062 A1 2/2007 McKinstry et al.
2007/0050207 A1 3/2007 Merszei
2007/0084749 A1 4/2007 Demelo et al.
2007/0157941 A1 7/2007 Awad et al.
2007/0157944 A1 7/2007 Catron et al.
2007/0199571 A1 8/2007 McCulloch
2007/0221240 A1 9/2007 Junsuh Lee

(56) References Cited

U.S. PATENT DOCUMENTS

2007/0227550 A1 10/2007 Merszei
2007/0272263 A1 11/2007 Gold
2007/0272264 A1* 11/2007 Byrne ..... A41G 5/02 132/201
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita et al.
2009/0028625 A1 1/2009 Bonneyrat
2009/0071490 A1 3/2009 Sthair
2009/0071492 A1 3/2009 Oh
2009/0178689 A1 7/2009 Navarro et al.
2009/0217936 A1 9/2009 Sato et al.
2009/0217939 A1 9/2009 Rabe et al.
2009/0223534 A1 9/2009 Green
2009/0241973 A1 10/2009 Hampton
2009/0241979 A1 10/2009 Navarro et al.
2009/0255547 A1 10/2009 Starks et al.
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie et al.
2010/0170526 A1* 7/2010 Nguyen ..... A41G 5/02 132/201
2011/0079233 A1 4/2011 Cheh
2011/0079235 A1 4/2011 Reed
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim et al.
2011/0278869 A1 11/2011 Lee et al.
2011/0290271 A1 12/2011 Rabe et al.
2011/0290937 A1 12/2011 Salkeld
2012/0037177 A1 2/2012 Teater Makinen
2012/0055499 A1* 3/2012 Sanbonmatsu ..... A41G 5/02 132/201
2012/0160259 A1 6/2012 Nguyen et al.
2012/0174939 A1 7/2012 Starks et al.
2012/0180804 A1 7/2012 Hochi et al.
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon et al.
2013/0160783 A1 6/2013 Ahn et al.
2013/0167855 A1 7/2013 Kupitz
2013/0167858 A1 7/2013 Lee
2013/0255706 A1 10/2013 Dinh
2013/0276807 A1 10/2013 Teater Makinen
2013/0298931 A1 11/2013 Samain et al.
2013/0306089 A1 11/2013 Araujo Costa
2013/0306094 A1 11/2013 West
2013/0312781 A1 11/2013 Murphy
2013/0312782 A1 11/2013 Kindall
2013/0320025 A1 12/2013 Mazzetta et al.
2013/0333714 A1 12/2013 Merszei
2014/0011372 A1 1/2014 Kato et al.
2014/0060559 A1 3/2014 Lin
2014/0069451 A1 3/2014 Hwang
2014/0083447 A1 3/2014 Rabe et al.
2014/0110304 A1 4/2014 Wu et al.
2014/0116456 A1 5/2014 Palmer-Rogers
2014/0135914 A1 5/2014 Conant
2014/0216488 A1 8/2014 Dinh
2015/0020840 A1 1/2015 Rabe et al.
2015/0075549 A1 3/2015 Lee et al.
2015/0114421 A1 4/2015 Pham
2015/0114422 A1 4/2015 Abraham et al.
2015/0114423 A1 4/2015 Sanbonmatsu
2015/0128986 A1 5/2015 Stookey
2015/0136162 A1 5/2015 Brouillet et al.
2015/0173442 A1 6/2015 Raouf
2015/0181967 A1 7/2015 Dinh
2015/0201691 A1 7/2015 Palmer-Rogers
2015/0201692 A1 7/2015 Hansen et al.
2015/0216246 A1 8/2015 Ahn et al.
2016/0016702 A1 1/2016 Siskindovich et al.
2016/0037847 A1* 2/2016 Tavakoli ..... A41G 5/02 132/201
2016/0037848 A1 2/2016 Lee
2016/0050996 A1 2/2016 Kwon
2016/0058088 A1 3/2016 Le
2016/0088889 A1 3/2016 Kettavong
2016/0135531 A1 5/2016 Ezechukwu
2016/0174645 A1 6/2016 Goldner
2016/0192724 A1 7/2016 Scott et al.
2016/0192725 A1 7/2016 Merszei
2016/0206031 A1 7/2016 Stoka
2016/0219959 A1 8/2016 Chipman et al.
2016/0286881 A1 10/2016 Ko
2016/0324241 A2 11/2016 Lee
2016/0324242 A1 11/2016 Hansen et al.
2016/0345648 A1 12/2016 Miniello et al.
2016/0353821 A1 12/2016 Calina
2017/0000204 A1 1/2017 Wibowo
2017/0006947 A1 1/2017 Uresti
2017/0020219 A1 1/2017 Beschta
2017/0049173 A1 2/2017 Dinh
2017/0055615 A1 3/2017 Crocilla
2017/0079356 A1 3/2017 Dinh
2017/0079357 A1 3/2017 Dinh
2017/0079358 A1 3/2017 Dinh
2017/0112214 A1 4/2017 Ahn
2017/0112215 A1 4/2017 Dinh
2017/0112264 A1 4/2017 Park
2017/0127743 A1 5/2017 Nakamura et al.
2017/0150763 A1 6/2017 Schroeder
2017/0208885 A1 7/2017 Alex
2017/0231309 A1 8/2017 Han
2017/0258163 A1 9/2017 Uresti
2017/0265550 A1 9/2017 Han et al.
2017/0311667 A1 11/2017 Passariello et al.
2017/0340041 A1 11/2017 Nguyen
2017/0347731 A1 12/2017 Chipman et al.
2017/0358245 A1 12/2017 Dana
2017/0360134 A1 12/2017 Crocilla
2017/0360135 A1 12/2017 Ahn
2017/0360136 A1 12/2017 Ferrier et al.
2018/0065779 A1 3/2018 Chiba
2018/0098591 A1 4/2018 Leeflang
2018/0160755 A1 6/2018 Hansen
2018/0235299 A1 8/2018 Stoka
2018/0242671 A1 8/2018 Merszei
2018/0242672 A1 8/2018 Lotti
2018/0242715 A1 8/2018 Lotti
2018/0352885 A1 12/2018 Kim
2018/0352886 A1 12/2018 Schroeder et al.
2019/0133227 A1 5/2019 Le
2019/0191851 A1 6/2019 Esposito et al.
2019/0254373 A1 8/2019 Kim
2019/0254374 A1 8/2019 Schroeder
2020/0093211 A1 3/2020 Lee
2021/0030140 A1 2/2021 Chico

FOREIGN PATENT DOCUMENTS

CN 203897379 U 10/2014
CN 302315323 10/2014
CN 303086463 10/2014
CN 304452297 10/2014
CN 305738664 10/2014
CN 305916370 10/2014
CN 303086463 1/2015
CN 104363790 2/2015

(56) References Cited

FOREIGN PATENT DOCUMENTS

| | | | |
|---|---|---|---|
| CN | 205274180 | | 6/2016 |
| CN | 304049505 | | 2/2017 |
| CN | 304049506 | | 2/2017 |
| CN | 304310042 | | 10/2017 |
| CN | 304329374 | | 10/2017 |
| CN | 304329375 | | 10/2017 |
| CN | 304382151 | | 12/2017 |
| CN | 304497372 | | 2/2018 |
| CN | 304777737 | | 8/2018 |
| CN | 304859863 | | 10/2018 |
| CN | 304859864 | | 10/2018 |
| EP | 1839526 | | 7/2009 |
| EP | 006381257 | | 10/2014 |
| EP | 006381257 | | 12/2018 |
| GB | 1021063 | | 2/1966 |
| GB | 1272616 | | 5/1972 |
| GB | 1307107 | | 2/1973 |
| JP | 471395 | U | 8/1972 |
| JP | 2011500979 | A | 1/2011 |
| JP | 2011122288 | A | 6/2011 |
| JP | 2011177395 | | 9/2011 |
| JP | 2015105447 | A | 6/2015 |
| JP | 3201846 | | 1/2016 |
| JP | 2016027220 | A | 2/2016 |
| JP | 2016163699 | A | 9/2016 |
| JP | 2019522125 | A | 8/2019 |
| KR | 200165452 | Y1 | 2/2000 |
| KR | 20090010717 | | 10/2009 |
| KR | 101336422 | B1 | 12/2013 |
| KR | 101509029 | | 4/2015 |
| KR | 20150140672 | A | 12/2015 |
| KR | 2001654552 | | 12/2018 |
| KR | 20190035787 | A | 4/2019 |
| WO | 2014163364 | A1 | 10/2014 |
| WO | 2018022914 | | 2/2018 |
| WO | 2018119034 | A1 | 6/2018 |

OTHER PUBLICATIONS

Born Pretty, False Eyelashes Thick Natural Simulation Recyclable Curly False Eyelash Makeup Cosmetic Tools, http://www.bornprettystore.com/false-eyelashes-thick-natural-simulation-recyclable-curly-false-eyelash-makeup-cosmetic-tools-p-44675.html downloaded from internet Oct. 18, 2018 (6 pages).

Buy Korea, Plastic, False Eyelash Applicator, Multy colour, http://www.buykorea.or.kr/product-details/Plastic-False-Eyelash-Applicator-Multy-colour-3106709.html, downloaded from internet Feb. 14, 2019 (3 pages).

Buzludzha Monument, Gueorguy Stoilov circa 1980, justanotherbackpacker.com, published by blogger Rich on Apr. 29, 2014 © 2019, online, site visited Aug. 27, 2019. Downloaded from Internet, URL: http://www.justanotherbackpacker.com/ buzludzha-monument-bulgaria-ufo/ (Year: 2014).

Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).

Cruiser Portable Speaker, NYNE, published at thegamerwithkids.com, posted by Sam Versionone on Apr. 6, 2015 © not listed, online, cite visited Jun. 20, 2018. Available from Internet. URL: https://thegamerwithkids.com/2015/04/06/nyne-cruiser-review-a-wireless-speaker-for-your-bycicle/ (Year: 2015).

Delicate Hummingbird, Ha! I've mastered the false lashes!, http://delicate hummingbird.blogspot.com/2011/11/ha-ive-mastered-false-lashes.htm., Nov. 10, 2011 (12 pages).

Dream Lashes Curved Volume Tweezer—3 Minute Test, https://www.youtube.com/watch7v:cw1qYeEOSD7s, downloaded from the internet Feb. 13, 2019 (1 paqe).

Electron Microscopy Sciences, "EMS High Precisions and Ultra Fine Tweezers." https://www.emsdiasum.com/microscopy/products/tweezers/ultra_fine.aspx. Downloaded from the internet Feb. 13, 2019 (7 pages).

European Search Report issued in EP17835287A dated Feb. 11, 2020 (5 pages).

European Search Report issued in EP17884561A dated Sep. 11, 2020 (7 pages).

First Office Action issued in CN201780004312A dated May 7, 2020 (17 pages).

First Office Action issued in CN201780033755A dated Aug. 28, 2020 (8 pages).

Focallure, https://shopfocallure.com/collections/eyelashes/products/eyelash-tweezer-by-focallure, downloaded from internet Feb. 14, 2019 (1 page).

Hongjun web page, https://detail.1686.com/offer/574685154963.html?spm=a2615.7691456.newlist.75.22f96dc5Msy00t, downloaded from internet Oct. 31, 2018 (16 pages).

International Search Report and Written Opinion dated Mar. 12, 2018 in related PCT/US2017/067513 filed Dec. 20, 2017 (10 pages).

International Search Report and Written Opinion dated Dec. 19, 2019 in related PCT/US2019/057104 filed Oct. 19, 2019 (8 pages).

International Search Report and Written Opinion dated Dec. 23, 2019 in related PCT/US2019/057102 filed Oct. 19, 2019 (8 pages).

International Search Report and Written Opinion dated Nov. 27, 2017 in related PCT/US2017/044217 filed Jul. 27, 2017 (10 pages).

Japonesque False Lash Applicator, https://japonesque.com/products/implements/false-lash-applicator/, downloaded from internet Feb. 13, 2019 (6 pages).

Lashify Wand, https:/iwww.instagrarn.com/p/BWgeQ8wgOOS/?iqshid=zauiyw8a6v5, downloaded from internet 2019 (1 page).

Pak Lajpall, Nail Artist Tweezers PL-1, http://www.laipall.com/proddetail.prod=nail-artists-tweezers 1, downloaded from internet Feb. 13, 2019 (1 paqe).

Peonies and Lilies, Bourjois 2 in 1 Tweezers and Faux & Fabulous Eyelashes, posted Oct. 24, 2012 (2 pages).

Yoyo PillBox, Alessi, amazon.com, published by Alessi on Nov. 20, 2018 © 1996-2020 Amazon.com, online, site visited Aug. 6, 2020. Available at URL: https://www.amazon.com/Alessi-Stainless-Steel-Michel-Bouquillon/dp/B07KKFQNQ6 (Year: 2018).

A True Lash Extension Look in Minutes Falscara The New Way to Lash, https://www.kissusa.com/falscara-false-eyelash-extension-look, retrieve on Feb. 5, 2021.

"Amazon.com : Kiss Ever Ez Lahes 30 Count Trio Lashes in Various Lengths 57927 : Beautyhttps://www.amazon.com/Kiss-Lahes-Lashes-Various-Lengths/dp/BOOJH7SR4SRetrieved on Mar. 9, 2021".

"BL Kiss Envy Quattro 01 Lashes—Two Pack, https://www.ebay.ca/itm/BL-Kiss-I-Envy-Quattro-O 1-Lashes-Two-PACK-/293706028541, Retrieved on Dec. 30, 2020".

Eyelash Tweezers—FEITA Precision Eyelash Extension Tweezers Set—Professional Straight & Curved Pointed Very Fine Tip Tweezers for Lash Extensions—Black—2Pcs, amazon.com/Eyelash-Tweezers-Precision-Extension-Professional/dp/B0112KSUDS.

"Eyelashes Clip—2 Pieces False Eyelashes Applicator Tool Eyelash Extension Tweezers Remover Clip Nipperamazon.co.uk/Eyelashes-Clip-Applicator-Extension-Tweezers/dp/B07PK6VBVW".

Hollyren, DIY Eyelash Extensions Superfine Band Cluster Lashes Kit, retrieve Feb. 5, 2021.

https://picclick com/i-ENVY-by-kiss-SO-Wispy-01-Strip-Eyelashes-292311410878.html, retrieved Dec. 30, 2020.

https://www.bicoastalbeauti.com/shop/kiss-brand-lashes/kiss-i-envy-premium-quattro/ KISS i-ENVY Premium Quattro 31 Lashes (KPE62), retrieved Dec. 30, 2020.

https://www.ebay.com/sch/i.html?_nkw=lenvy&norover=1&mkevet=1&mkevt=1&mkrid=711-156598-701868-2&mkcid=2&keywprd=ienvy&crip=435059434779_&, lenvy, retrieved Dec. 30, 2020.

https7/www.madamemadeline.com/online_shoppe/proddetail.asp?prod=mmKPE62, KISS i-ENVY Premium Quattro 01 Lashes (KPE62), retrieved Dec. 30, 2020.

I-ENVY by Kiss SO WISPY #01 Strip Eyelashes KPE58 False Lashes Black 1 pair NEW, https://www.picclickimg.com/d/w1600/picV292311410878 li-ENVY-by-Kiss-SO-WISPY-01-Strip-Eyelashes.jpg) retrieved Dec. 30, 2020.

(56) References Cited

OTHER PUBLICATIONS

Ienvy https://www.ebay.com/sch/i.html?_ nkw=lenvy&norover=1&mkevt=1&mkrid=711-156598-701868-2&mkcid=2&keyword=Ienvy&crlp=435059434779, retrieved Dec. 30, 2020.
Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).
"KISS—Ever Ez Lashes 30 Count Trio Lashes in Various Lengthshttps://www.amazon.com/Kiss-Lahes-Lashes-Various-Lengths/dp/B00JH7SP4S; Retrieved Mar. 9, 2021".
"KISS—i-ENVY 100% Human Eyelash So Wispy 03;https://www.pinterest.co.kr/pin/308285536984155041/Retrieved Dec. 30, 2020".
"KISS—I-Envy by Kiss 100% Human Pre Cut Eyelash Quattro 02 Lashes, https://www.pinterest.cl/pin/576038608568497288/?amp_client_id=CLIENT_ID(_)&mweb_unauth_id=&from_amp_pin_page=true, Retrieved Dec. 30, 2020".
"KISS—I-Envy by Kiss Premium Quattro 02 Lashes, https://www.lashaddict.nl/kiss-i-envy-lashes-quattro-02.html, Retrieved Dec. 30, 2020".
"KISS—I-Envy by Kiss Premium Quattro 02 Lashes, https://www.ubuy.com.kw/en-sa/catalog/product/view/id/37236, Retrieved Dec. 30, 2020".
"KISS—I-Envy by Kiss Premium Quattro 02 Lashes, https://www.walmart.com/ip/Kiss-I-Envy-Quattro-02-Lashes/187353459, Retrieved Dec. 30, 2020".
"KISS—iENVY Collection;ienvybykiss.com; Retrieved Dec. 30, 2020".
"KISS—I-ENVY Eye Lash Adhesive (6g Individual, Clear) Reviews; https://www.influenster.com/reviews/kiss-i-envy-eye-lash-adhesive-6g-individual-clear;Retrieved Dec. 30, 2020".
"KISS—I-ENVY Individual Eye Lash Adhesive; https://www.modernbeauty.com/cosmetics/lashes/false-lashes/product/26961-i-envy-individual-eyelash-adhesive-retail.html;Retrieved Dec. 30, 2020".
"KISS—i-ENVY Pre-Cut Lashes, https://www.shopbeautylicious.com/products/kiss-i-envy-pre-cut-lashes; Retrieved Dec. 30, 2020".
"KISS—i-ENVY Premium Quattro 01 Lashes, https://www.amazon.ca/Kiss-ienvy-quattro-Makeup-Count/dp/B016SKJJKM; Retrieved Dec. 30, 2020".
"KISS—i-ENVY Premium Quattro 01 Lashes, https://www.ammancart.com/products/kiss-i-envy-premium-quattro-01-lashes-kpe62; Retrieved Dec. 30, 2020".
"KISS—i-ENVY Premium Quattro 01 Lashes, https://www.beautyproductsusa.com/home/322-kiss-i-envy-strip-eyelash-quattro-01-kpe62.html; Retrieved Dec. 30, 2020".
"KISS—i-ENVY Premium Quattro 01 Lashes, https://www.bicoastalbeauti.com/shop/kiss-brand-lashes/kiss-i-envy-premium-quattro/; Retrieved Dec. 30, 2020".
"KISS—i-ENVY Premium Quattro 01 Lashes, https://www.biloltd.net/product-p/60351.htm; Retrieved Dec. 30, 2020".
"KISS—i-ENVY Premium Quattro 01 Lashes, https://www.cashmerecosmetics.com/product/kiss-i-envy-quattro-01-lashes/; Retrieved Dec. 30, 2020".
"KISS—i-ENVY Premium Quattro 01 Lashes, https://www.ebay.com/p/1044019861; Retrieved Dec. 30, 2020".
"KISS—i-ENVY Premium Quattro 01 Lashes, https://www.loveyelashes.com/bfont-colorgreenstrip-lashesfontb-299-ienvy-by-kiss-quattro-01-(1555,129,1,48)p.html#; Retrieved Dec. 30, 2020".
"KISS—i-ENVY Premium Quattro 01 Lashes, https://www.ussalonsupply.com/Kiss-I-Envy-Quattro-01-Lashes-_p_120305.html; Retrieved Dec. 30, 2020".
KISS—i-ENVY Premium Quattro 01 Lashes, https://www.madamemadeline.com/online_shoppe/proddetail.asp?prod=mmKPE62; Retrieved Dec. 30, 2020.
"KISS—i-ENVY Quattro 01 Lashes, pack of 3https://www.amazon.com/iEnvy-Kiss-Quattro-Lashes-Pack/dp/B06XGBTCHW; Retrieved Dec. 30, 2020".
"KISS—i-ENVY Quattro 02 Lashes, pack of 3https://www.amazon.com/iEnvy-Kiss-Quattro-Lashes-Pack/dp/B017O6J2FG; Retrieved Dec. 30, 2020".
"KISS—i-ENVY Strip Eyelashes—Pack of 2,https://www.ebay.com.au/itm/Kiss-I-Envy-Strip-Eyelashes-Pack-of-2-Choose-your-Style/183303124469; Retrieved Dec. 30, 2020".
"KISS—i-ENVY Trio Lashes Ultra Volumehttps://www.unitedbeautysupply.com/product/kiss-i-envy-trio-lashes-ultra-volume-kpec/; Retrieved Mar. 9, 2021".
"KISS—i-ENVY Trio Medium Lashes 30 Trio Lashes, 2 pk.https://www.amazon.com/Kiss-Envy-Trio-Medium-Lashes/dp/B018J0RMXU; Retrieved Mar. 9, 2021".
"KISS—i-ENVY Ultra Black Trio Medium Lashes, 2 pk.https://www.amazon.com/Kiss-Envy-Ultra-Black-Medium/dp/B00W2C4HPS?th=1; Retrieved Mar. 9, 2021".
KISS—So Wispy 01 Strip Eyelashes, https://picclick.com/i-ENVY-by-Kiss-SO-WISPY-01-Strip-Eyelashes-292311410878.html; Retrieved Dec. 30, 2020.
"Kiss Ever EZ Trio Lashes Medium Combo 30 EA 2pk,https://www.ebay.com/urw/Kiss-Ever-EZ-Trio-Lashes-Medium-Combo-30-EA-2pk/product-reviews/111 7964400?pgn=2#Retrieved on Mar. 9, 2021".
Lashify Gossamer Lash Cartridge https://lashify.com/collections/shop-1/products/gossamer-eye-lozenge-c-style?variant= 783670738950, downloaded from internet Jun. 15, 2018 (2 pages).
Lindström, I., Suojalehto, H., Henriks-Eckerman, M.L. and Suuronen, K., 2013. Occupational asthma and rhinitis caused by cyanoacrylate-based eyelash extension glues. Occupational medicine, 63(4), pp. 294-297.
MAC Cosmetics, 34 Lash, http://www.bornpretty/store.com/fa!se-eyelashes-thick-natural-simulation-recyclable-curly-false-eyelash-makeup-cosmetic-tools-p-44675.html, downloaded from internet Feb. 14, 2019 (1 page).
Madame Madeline got lashes? KISS i-ENVY Premium Quattro 01 Lashes (KPE62), i-ENVY Strip Lashes by KISS—Madame Madeline Lashes, retrieved Dec. 30, 2020.
"Madame Madeline Lashes, Ardell Dual Lash Applicator, https://www.madamemadeline.com/online_shoppe/proddetail.asp?prod=mm62059, downloaded frominternet Oct. 18, 2018 (3 pages).".
Made in China, New Product Eyelashes Aid Eyelashes Applicator Innovative Eyelashes Curler, 2018, https://www.made-in-china.com/productdirectory.do?word=creative+eyelashe+curler&subaction=hunt&style=b&mode=and&code=0&comProvince=nolimit&order=0&isOpenCorrection=1, downloaded from internet Feb. 13, 219(2 pages).
"Pinterest—How to Apply iENVY Quattro collection eyelashes,https://www.pinterest.com/pin/43347215141316080/ Retrieved Dec. 30, 2020".
Pinterest search for False Eyelases: Kiss Premium Lashes, i-ENVY by KISS Premium Lashes, Lashes, False eyelashes, eyelashes; https://www.pinterest.es/amp/pin/449515606533816815/, Retrieved Dec. 30, 2020.
Pinterest search from kissusa.com; https://www.pinterest.com.au/pin/19562579608263895/; Retrieved Dec. 30, 2020.
Kiss Nail Products, Inc.'s Third Supplemental Objections and Responses to Lashify, Inc.'s First Set of Interrogatories (Nos. 1-56) Investigation No. 337-TA-1226, Mar. 10, 2021.
Notter E. The Art of the Chocolatier: From Classic Confections to Sensational Showpieces. John Wiley & Sons; Jan. 1, 20118.
International Search Report and Written Opinion dated May 7, 2020, on application No. PCT/US2020/013561.
Troughton MJ. Handbook of plastics joining: a practical guide. William Andrew; Oct. 17, 2008.
Varga J, Ehrenstein GW, Schlarb AK Vibration welding of alpha and beta isotactic polypropylenes: Mechanical properties and structure. Express Polymer Letters. Mar. 1, 2008;2(3):5-19.
Brandrup, J., Immergut, E.H., Grulke, E.A., Abe, A. and Bloch, D.R. eds., 1999. Polymer handbook (vol. 89). New York: Wiley.
Satkowski, M.M., 1990. The crystallization and morphology of polyethylene and its blends.
Melting and Crystallization of Poly(ethylene Terephthalate) under Pressure, ,Journal of Polymer Science: Polymer Physics Edition, vol. 18, 2181-2196 (1980) @ 1980 John Wiley & Sons, Inc.
How to Apply Lashing using Sephora Bull Eye Lash Applicator, Nov. 14, 2012 youtube video, https://www.youtube.com/watch?v=yYwcYzXJX4M.

(56) References Cited

OTHER PUBLICATIONS

Aug. 18, 2015 "How to apply iENVY Quattro collection eyelashes" Quatro Video—https://www.youtube.com/watch?v=kW-ovIGoCmc.
Ienvy https://www.ebay.com/sch/i.html?_ nkw=Ienvy&norover=1&mkevt=1&mkrid=711-156598-701868-2&mkcid=2&keyword=ienvy&crip=435059434779, retrieved Dec. 30, 2020.
Japanese Office action dated Aug. 30, 2021, on application No. 2019-504850.

* cited by examiner

ARTIFICIAL LASH EXTENSIONS

CROSS-REFERENCE TO RELATED APPLICATIONS

The present application is a continuation of U.S. patent application Ser. No. 16/556,518, filed Aug. 30, 2019, which is a continuation of U.S. patent application Ser. No. 15/968,361 filed May 1, 2018, now U.S. Pat. No. 10,660,388 issued May 26, 2020; which is a continuation of International Application No. PCT/US17/44217 filed Jul. 27, 2017; which claims the benefit of U.S. Provisional Application No. 62/368,116 filed Jul. 28, 2016; the contents of all of which are incorporated herein by reference in their entirety herein.

FIELD OF THE INVENTION

Various embodiments concern artificial eyelashes and, more specifically, clusters of artificial eyelash extensions that can be applied to the underside of an individual's natural eyelashes.

BACKGROUND

Eyelash extensions have conventionally been used to enhance the length, thickness, and fullness of natural eyelashes. Eyelash extensions, however, must be applied to an individual's natural eyelashes one by one to avoid having the eyelash extensions stick together. Consequently, lash extension services can cost hundreds of dollars depending on the type and number of lashes used, the skill of the cosmetician, and the venue where the eyelash extensions are applied. It usually takes an experienced cosmetician one to two hours to attach a full set of eyelash extensions.

Clusters of artificial lashes have conventionally been used to enhance the length, thickness, and fullness of an individual's natural eyelashes. However, each cluster must be applied to the individual's eyelashes individually in order to avoid having the clusters of artificial lashes stick together and to ensure multiple clusters are evenly distributed across the width of the individual's lash line.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

BRIEF DESCRIPTION OF THE DRAWINGS

Various embodiments are illustrated by way of example and not limitation in the accompanying drawings, in which like references indicate similar elements. Various objects, features, and characteristics of the present invention will become more apparent to those skilled in the art from a study of the Detailed Description in conjunction with the accompanying drawings.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Conventional eyelash extensions (or simply "lash extensions") are individually adhered to an individual's eyelashes one-by-one in order to prevent the eyelash extensions from sticking together. However, because the average individual might have anywhere from thirty to eighty lashes per eye, the application process can take several hours to attach a full set of eyelash extensions.

Introduced here, therefore, are techniques for creating clusters of artificial lash extensions that can be applied to an individual's natural eyelashes. Clusters of artificial lashes include multiple artificial hairs made of natural materials (e.g., silk or authentic mink hair) or synthetic materials (e.g., acrylic resin, polybutylene terephthalate (PBT), or synthetic mink hair made of polyester). A cluster of artificial lashes generally includes approximately 10 to 30 artificial hairs (and preferably 10 to 20 artificial hairs). Clusters of artificial lashes are initially formed using, for example, a hot melt method in which artificial lashes are heated. For example, in some embodiments linear artificial lashes are heated at one end such that they begin to fuse to one another at that end, while in other embodiments linear artificial lashes are heated near a central point and folded underneath one another. Clusters of artificial lashes have conventionally been made available only to professional lash technicians and cosmeticians.

Figure 1:
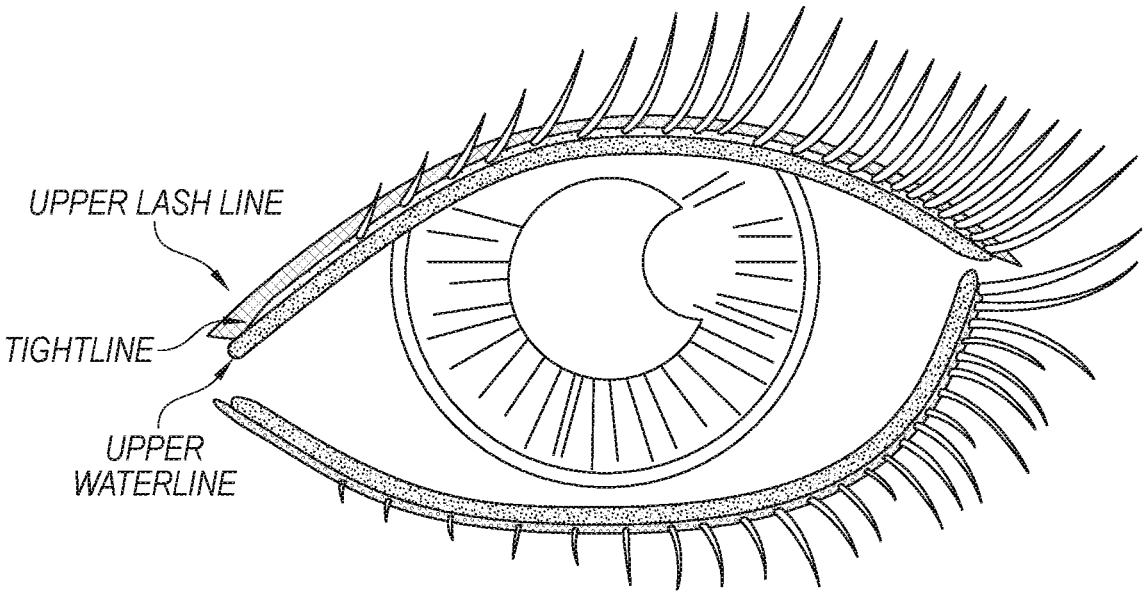
FIG. 1 depicts the upper tightline, upper lash line, and upper waterline of an eyelid.

Multiple clusters can then be fused together to form a bundle (also referred to as a "lash fusion") that can be applied along the upper tightline in a single motion. As shown in FIG. 1, the upper tightline is interposed between the upper lash line and the upper waterline. While certain embodiments have been described in the context of lash fusions that include multiple clusters, those skilled in the art will recognize that a lash fusion could also include a series of individual artificial hairs that are connected to one another.

More specifically, a lash fusion can include multiple clusters that are fused together near the inner ends of the artificial lashes (also referred to as the "base" of the lash fusion) to form a straight line of artificial hairs that can be placed underneath an individual's natural lashes. For example, the multiple clusters can be fused together (e.g., via a heat seal process) approximately 1-5 millimeters (mm) above the base via crisscrossing artificial hairs. In some embodiments, the multiple clusters are fused together approximately 1.5-2.5 mm above the base. The distance from the base at which fusing occurs may depend on the desired fan-out of the artificial lashes (e.g., shorter distances may cause a larger fan-out). Adjacent clusters can be secured to one another when the intersecting portions of the crisscrossing artificial hairs are fused together. Such a technique allows a set of multiple lash fusions to appear seamless and blend in with an individual's natural lashes.

The base of the lash fusion (i.e., where the multiple clusters are fused together) is intended to be affixed to an individual's natural lashes. The lash fusion may be approximately 4-8 mm wide. A lash fusion could include 3-10, 3-7, 5-10, 5-7, or 4-6 clusters. Accordingly, a lash fusion could include 30-150, 30-120, or 30-90 individual artificial hairs.

A set of multiple lash fusions can then be formed by arranging the multiple lash fusions next to one another in a form that matches the curvature of the upper tightline along the base of an eyelid. While the multiple lash fusions are typically not connected to one another (e.g., are not fused together using heat, an adhesive, etc.), the entire set can be applied to the underside of the individual's natural lashes in a single motion. A set could include 3-8, 3-5, 5-8, or 4-6 lash fusions. Accordingly, a set could include 150-360 individual artificial hairs.

The number of lash fusions in a set may vary. In fact, because the multiple lash fusions are typically not secured to one another, an individual could decide to apply part of a set (e.g., five lash fusions rather than six lash fusions) based on the desired density.

Density of the artificial hairs may vary across the width of the eyelid. In some embodiments the artificial hairs are distributed evenly across the entire tightline (i.e., each cluster/lash fusion can include a substantially similar number of artificial lashes), while in other embodiments the artificial hairs are more densely populated in certain area(s) of the tightline (i.e., some clusters/lash fusions may include fewer artificial lashes than others). For example, density may be lower along the outer edge opposite the tear duct.

An adhesive may be applied to the top of each lash fusion within a set during the manufacturing process, which enables an individual to easily apply the set of lash fusions directly to the underside of the individual's eyelashes rather than to the individual's eyelid. Additionally or alternatively, the individual could apply an adhesive before applying the set of lash fusions to the individual's natural eyelashes. For example, the individual may apply an adhesive to the set of lash fusions before applying the set of lash fusions to the natural eyelashes. As another example, the individual could apply an adhesive directly to the natural eyelashes. The adhesive could be a waterproof glue or mascara.

Terminology

Brief definitions of terms, abbreviations, and phrases used throughout this application are given below.

Reference to "one embodiment" or "an embodiment" means that a particular feature, structure, or characteristic described in connection with the embodiment is included in at least one embodiment of the disclosure. The appearances of the phrase "in some embodiments" are not necessarily referring to the same embodiment, nor are they necessarily referring to separate or alternative embodiments that are mutually exclusive of one another.

The terms "connected," "coupled," or any variant thereof includes any connection or coupling between two or more elements, either direct or indirect. The coupling or connection between the elements can be physical, logical, or a combination thereof. For example, two components may be coupled directly to one another or via one or more intermediary channels/components. The words "associate with," meanwhile, mean connecting or relating objects, items, etc.

System Topology Overview

Figure 2:
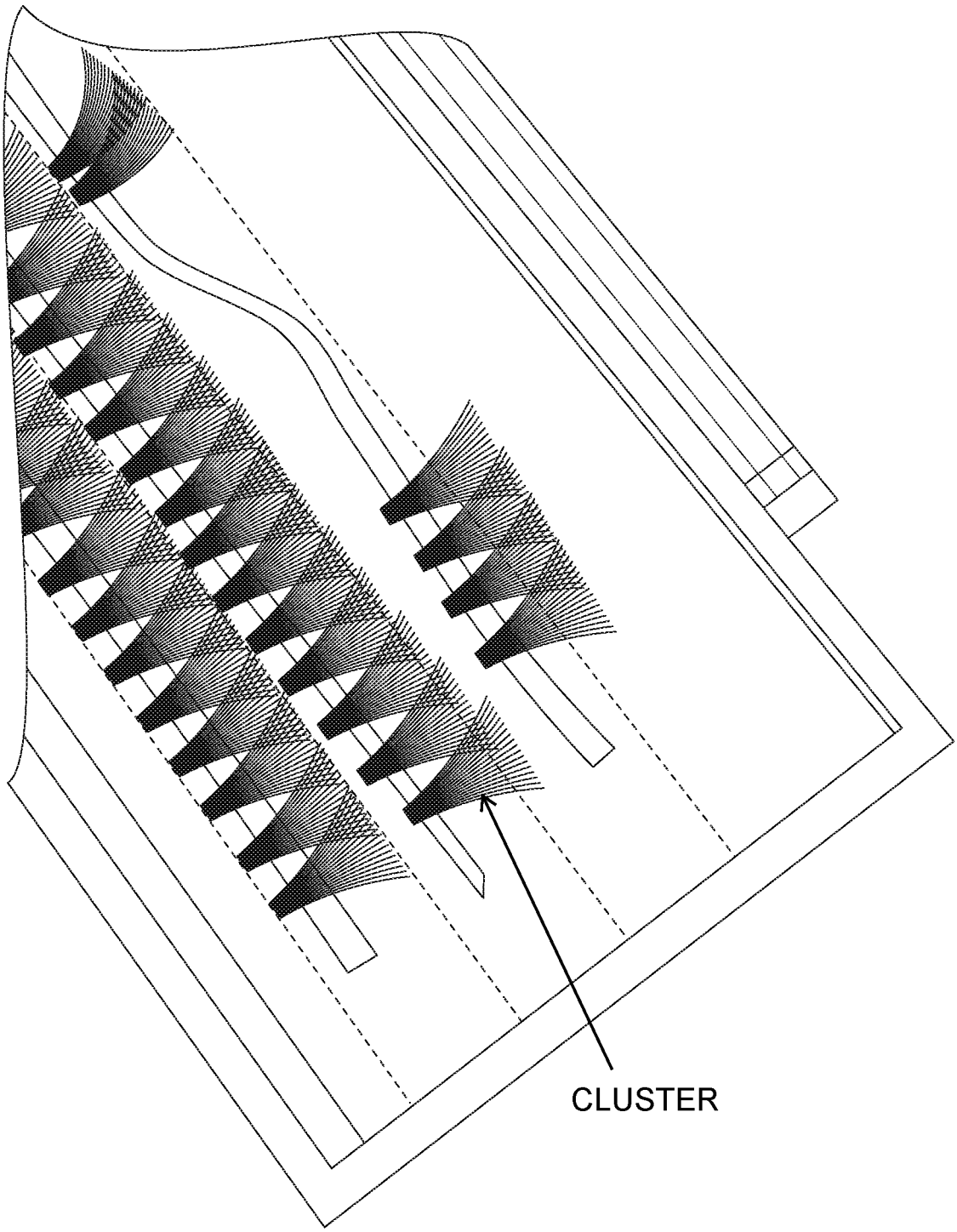
FIG. 2 depicts clusters of artificial lashes that can be used by professional lash technicians and cosmeticians.

FIG. 2 depicts clusters of artificial lashes that can be used by professional lash technicians and cosmeticians. Each cluster of artificial lashes includes multiple artificial hairs that consist of natural materials (e.g., silk or authentic mink hair) or synthetic materials (e.g., acrylic resin, PBT, or synthetic mink hair made of polyester).

Clusters of artificial hairs typically include 10 to 30 hairs that are heated (e.g., as part of a hot melt process) and then secured to one another. For example, in some embodiments linear artificial lashes are heated at one end such that they begin to fuse to one another at that end, while in other embodiments linear artificial hairs are heated near a central point and folded underneath one another.

In some embodiments, some or all of the artificial hairs within a cluster may be tied to a support thread (i.e., knotted). The artificial hairs may be tied by any such means, such as a slip knot that prevents horizontal spreading of the cluster.

Figure 3A:
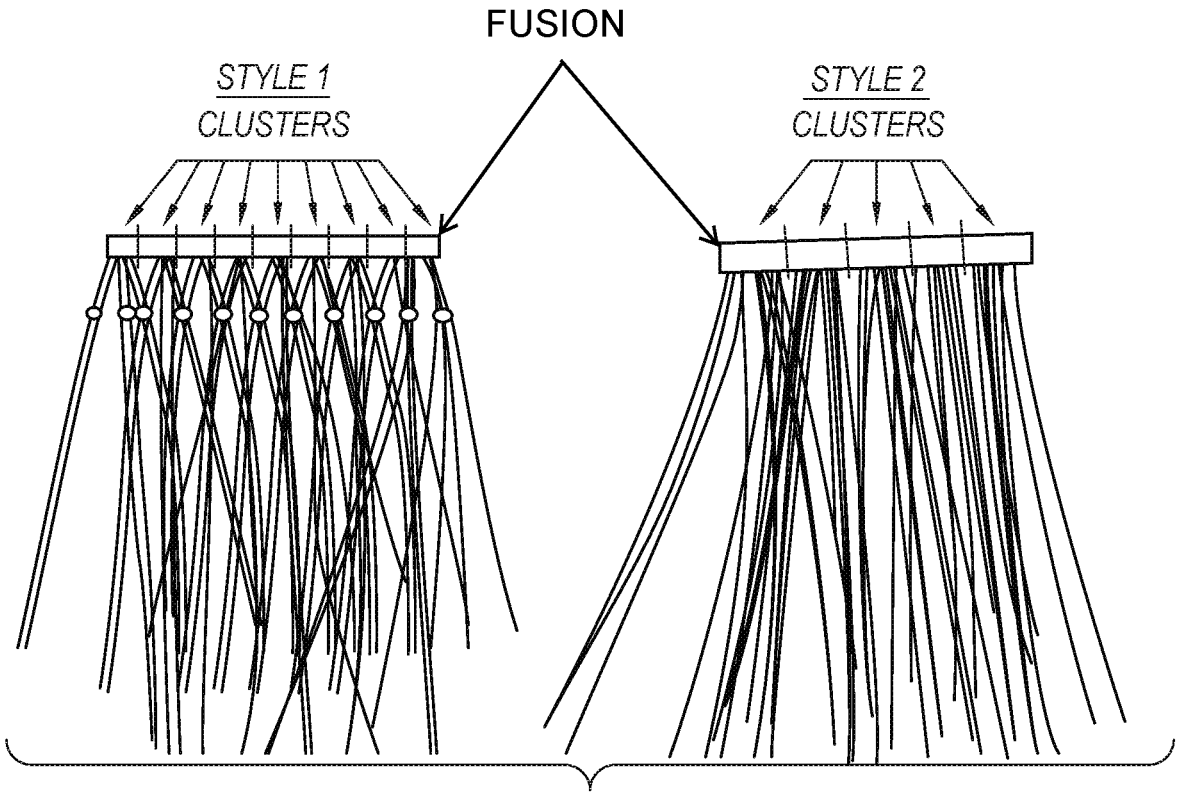
FIG. 3A depicts how multiple clusters of artificial lashes can be connected to form a bundle (also referred to as a "lash fusion").

FIG. 3A depicts how multiple clusters of artificial lashes can be connected to form a bundle (also referred to as a "lash fusion"). More specifically, the lash fusion can include multiple clusters that are fused together near the base to form a straight line of artificial hairs that can be applied along the upper tightline.

For example, the multiple clusters can be fused together (e.g., via a heat seal process) approximately 1-5 mm above the base via crisscrossing artificial hairs. In some embodiments, the multiple clusters are fused together approximately 1.5-2.5 mm above the base. Adjacent clusters can be secured to one another when the intersecting portions of the crisscrossing artificial hairs are fused together. Such a technique allows a set of multiple lash fusions to appear seamless and blend in with an individual's natural lashes.

The intersecting portions of the crisscrossing artificial hairs could also be connected using an adhesive (i.e., rather than being fused together via a hot melt process). In such embodiments, the multiple clusters may be exposed to a curing assembly (e.g., a heater, dryer, or light source) that causes the adhesive to solidify. Artificial lashes made of natural materials (e.g., human or authentic mink hair) are typically connected using a glue or other adhesive rather than through the hot melt process.

A lash fusion could include 3-10, 3-7, 5-10, 5-7, or 4-6 clusters. Accordingly, a lash fusion could include 30-90 individual artificial hairs. Here, for example, a first style of lash fusion includes nine clusters, while a second style of lash fusion includes five clusters.

Note, however, that both styles could include the same number of artificial lashes. For example, the first style of lash fusion may include nine clusters of five artificial lashes each, while the second style of lash fusion may include five clusters of nine artificial lashes each. Both styles could also include different numbers of artificial lashes (e.g., the first style may include a higher density of artificial lashes, and thus be more appropriate for placement near the tear duct).

Lash fusions may be 4-8 mm wide, though embodiments are often 5-6 mm wide. This is much wider than conventional clusters (which are 1.5-2 mm wide), and thus provide greater coverage along the eyelid.

Figure 3B:
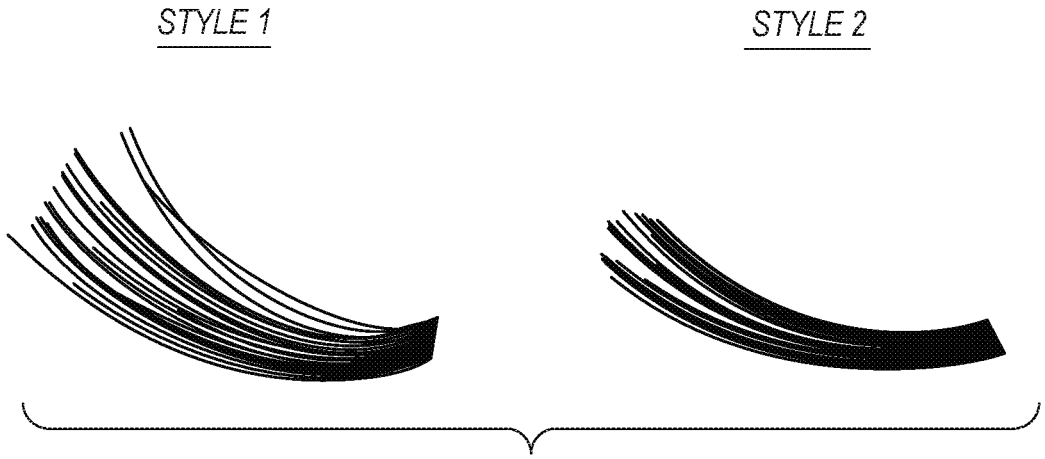
FIG. 3B is a side view of two different styles of lash fusion.

FIG. 3B is a side view of two different styles of lash fusion. The multiple clusters of each lash fusion can be fused to one another (e.g., during a hot melt process). Such a design provides several advantages over conventional clusters of lash extensions.

For example, because the multiple clusters can be heat sealed to one another, the total height at the base of the lash fusion is only 0.05-0.15 mm. Conventional clusters, meanwhile, use a string at the base to connect the artificial hairs to one another. But the presence of the string causes the total height at the base of the cluster to exceed 0.3 mm (e.g., typically 0.3-0.7 mm).

Moreover, the lash fusions described here have no quantifiable weight. Therefore, the lash fusions can more easily adhere to an individual's natural lashes and remain secured for longer periods of time. Again, the presence of the string causes conventional clusters to have a quantifiable weight that affects how they must be adhered to the individual's natural lashes.

Figure 3C:
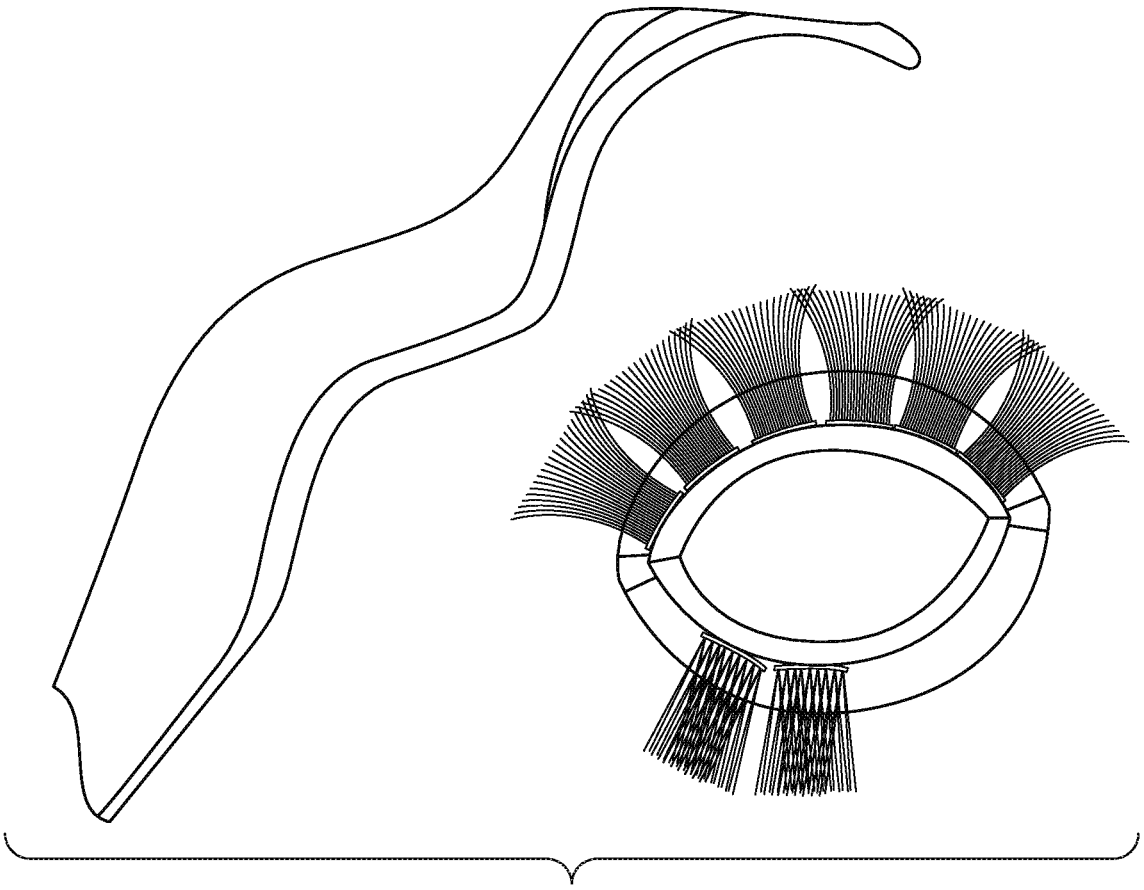
FIG. 3C illustrates how a set of multiple lash fusions can be secured to an individual's lashline in a single motion.

FIG. 3C illustrates how a set of multiple lash fusions can be secured to an individual's lashline in a single motion. A set can include multiple lash fusions that are arranged to match the curvature of the upper tightline of an eyelid. For example, multiple lash fusions may be arranged such that the inner ends (i.e., the bases) form a concave shape that substantially complements the universal tightline of nearly any human eye. In some embodiments, sets preferably include five to seven distinct clusters of artificial lashes. The number of lash fusions within each set (as well as the number of clusters within each lash fusion) may be based on the thickness of the artificial hair used, the desired style of the eyelid on which the set is intended to be affixed, the desired lash density (also referred to as "fullness" of the individual's lashes), etc. As shown in FIG. 3C, the set of lash fusions is aligned with the tightline rather than the lash line, and then affixed to the underside of the individual's natural lashes. Said another way, the set of lash fusions is applied directly to the underside of the natural lashes rather than to the eyelid.

An adhesive can be applied to the top of each lash fusion in the set, which enables an individual to easily apply the set directly to the natural lashes. The individual responsible for applying the set of lash fusions could be a person who affixes the lash fusions to herself or some other person (e.g., a professional lash technician or a cosmetician). In some embodiments, the adhesive is applied when the lash fusions and/or the set are initially manufactured. Additionally or alternatively, the individual could apply an adhesive before attaching the set of lash fusions to the individual's natural lashes.

The adhesive could be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include:

Arcrylates/ethylhexyl acrylate copolymer, aqua, propylene glycol, ceteareth-25, hydrogenated castor oil, glycerin, phenoxyethanol, 2-bromo-2-nitropropane-1, 3-diol, methylcholoroisothiazolinone, methylisothiazolinone, methylparaben, and optionally a color agent (e.g., black 2 (C1 77266));

Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT));

Chlorine dioxide, p-anisic acid, biotin, lavandula angustifolio oil, propylene glycol, water, 2-ethylhexyl acrylate, and optionally a preservative (e.g., benzalkonium chloride); and Acrylate copolymer and water.

Those skilled in the art will recognize that many other adhesive compositions are possible and, in fact, may be desirable for individuals having certain allergies, desiring certain fixation duration (also referred to as "permanency" of the lash extensions), etc.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

Figure 4:
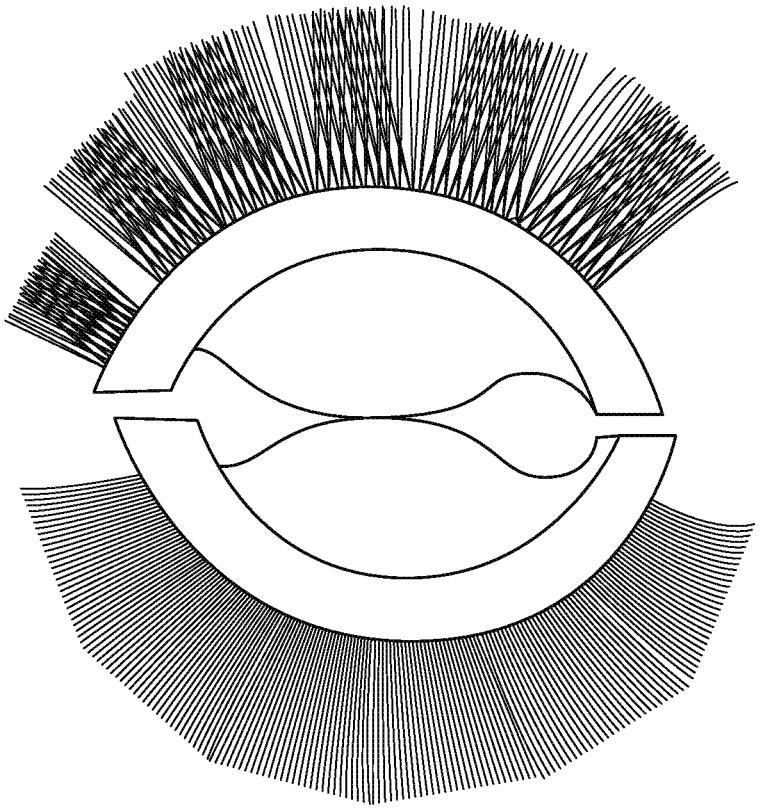
FIG. 4 illustrates how multiple lash fusions within a set can be positioned in a specified arrangement.

FIG. 4 illustrates how multiple lash fusions within a set can be positioned in a specified arrangement. While the multiple lash fusions within the set will typically not be connected to one another, the multiple lash fusions can be arranged such that the set substantially complements the shape of an eyelid. More specifically, the curvature of the multiple lash fusions may substantially match the tightline curvature of an average person. Thus, an entire set of lash fusions may become substantially flush with the lash line when the set is arranged proximate to the tightline. Together, the multiple lash fusions form a set of lash extensions that can be collectively applied in a single motion.

Figure 5:
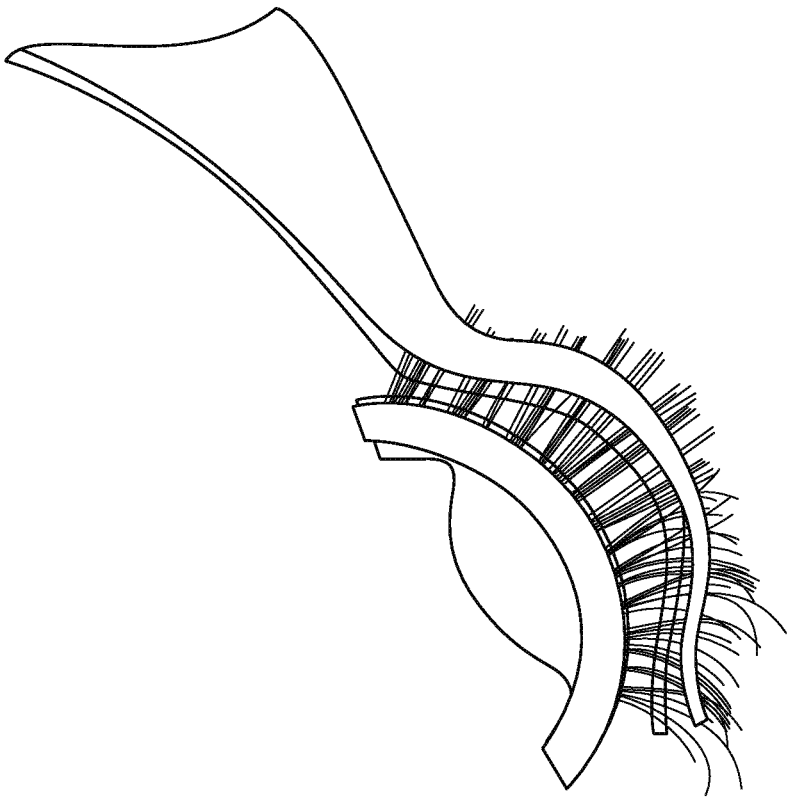
FIG. 5 depicts how the arrangement of the set of lash extensions enables all of the lash fusions to be simultaneously grasped by an applicator.

FIG. 5 depicts how the arrangement of the set of lash extensions enables all of the lash fusions to be simultaneously grasped by an applicator. More specifically, an individual or a healthcare professional, such as a lash technician or cosmetician, can grasp an entire set of lash extensions using the applicator and simultaneously apply the entire set of lash extensions to the individual's natural eyelashes in a single motion.

Figure 6:
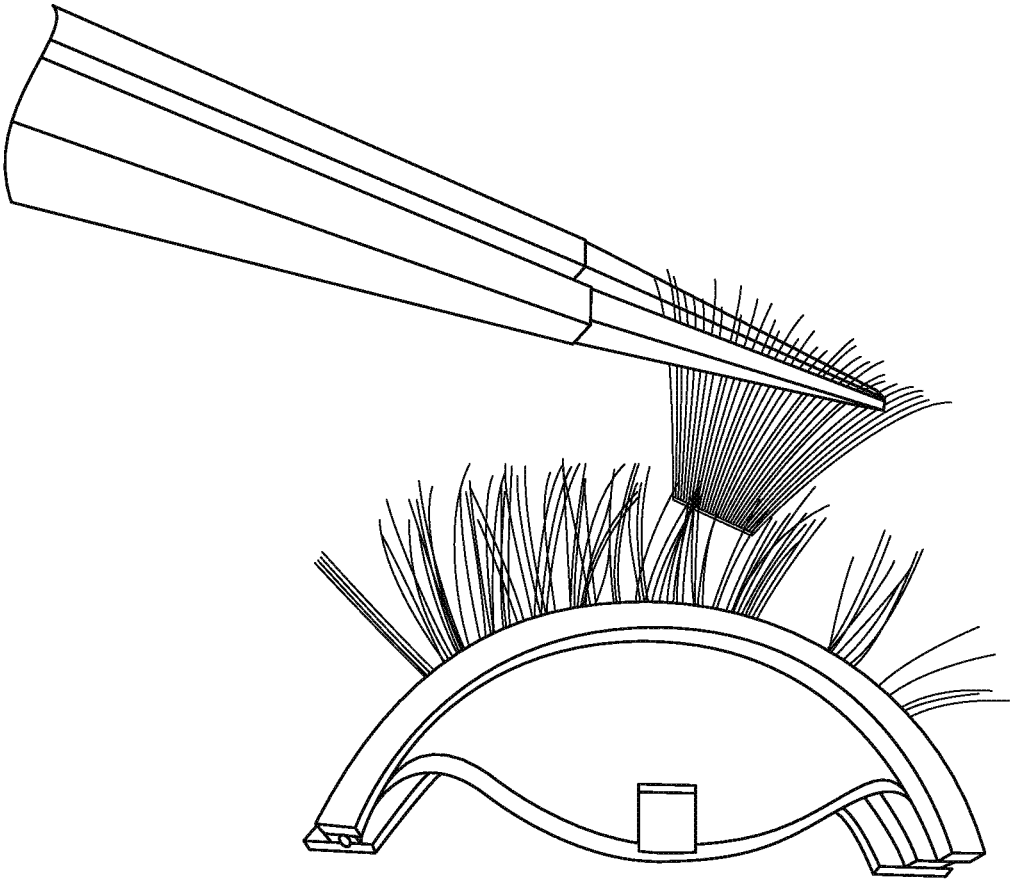
FIG. 6 depicts how the set of lash fusions can be placed underneath an individual's natural lashes, where the plastic represents the individual's eyelid.

FIG. 6 depicts how the set of lash fusions can be placed underneath an individual's natural lashes, where the plastic represents the individual's eyelid. As further described below, an adhesive is applied to the top of each lash fusion in the set of lash extensions. Consequently, the set of lash extensions can be applied directly to the underside of the individual's natural lashes proximate to the tightline, rather than to the eyelid above the lash line.

Figure 7:
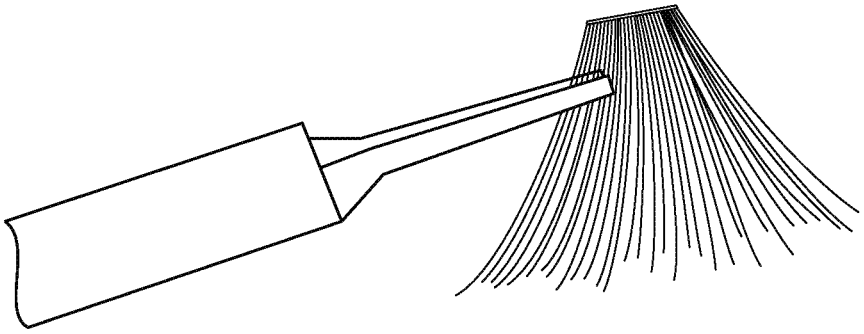
FIG. 7 depicts how an adhesive can be applied to the top of an entire set of lash extensions or to the lash fusions that make up the set.

FIG. 7 depicts how an adhesive can be applied to the top of an entire set of lash extensions or to the lash fusions that make up the set. Additionally or alternatively, an adhesive could be applied to the individual's natural lashes. The adhesive applied to the artificial lash extensions may the same adhesive applied to the individual's natural lashes or a different adhesive.

Such a technique enables the individual to easily apply the set of lash extensions directly to the underside of the individual's natural lashes proximate to the tightline, rather than to the individual's eyelid adjacent to the lash line. While multiple lash fusions are typically arranged with the intention that they be simultaneously grasped and applied to the individual's natural lashes, the individual could also individually apply the lash fusions.

The adhesive could be a semi-permanent glue or mascara. In some embodiments, the adhesive includes an oil-soluble polymer or a water-soluble polymer that helps to enhance adhesion and substantivity of the artificial lash extensions to the individual's natural eyelashes. The adhesive may be a waterproof formulation that allows the set of lash extensions to remain affixed to the individual's natural lashes for longer periods of time (e.g., days, weeks, or months).

Although latex-based adhesives are generally avoided to avoid irritation of the individual's eyelid (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

Figure 8:
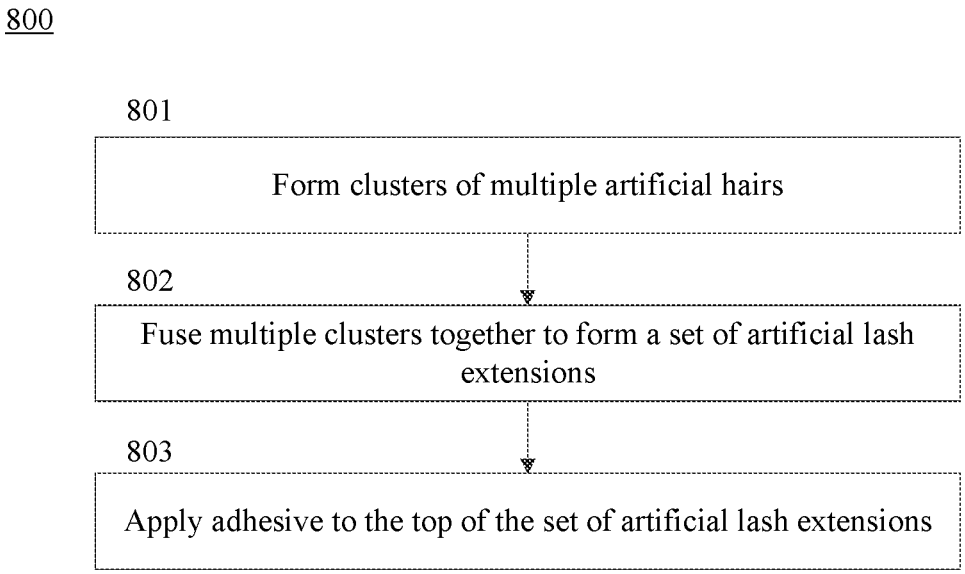
FIG. 8 depicts a flow diagram of a process for manufacturing a lash fusion including multiple clusters of artificial lashes.

FIG. 8 depicts a flow diagram of a process 800 for manufacturing a lash fusion including multiple clusters of artificial lashes. Clusters of artificial lashes are initially formed using, for example, a hot melt method in which artificial hairs are heated and connected to one another (step 801). In some embodiments, linear artificial hairs are heated at one end such that they begin to fuse to one another at that end, while in other. In other embodiments, linear artificial hairs are heated near a central point and folded proximate to the central point (i.e., so that a single artificial hair appears as two artificial lashes). Artificial hairs can then be overlapped (e.g., near the fused end or central fold) to form a cluster.

The hot melt method requires that the multiple artificial hairs be heated to a temperature that is sufficient to cause the individual lashes to begin to melt. For example, artificial hairs made of PBT could be heated to approximately 55-110° C. at one end during a heat seal process (during which the heated ends begin to fuse to one another). Note, however, that clusters could include artificial hairs that consist of natural materials (e.g., silk or authentic mink hair) or synthetic materials (e.g., acrylic resin, PBT, or synthetic mink hair made of polyester). While clusters may include 10 to 90 artificial hairs, most clusters include 10 to 30 artificial hairs.

Multiple clusters can then be connected together to form a lash fusion (step 802). More specifically, the lash fusion can include multiple clusters that are fused together near one end (i.e., the base) to form a straight line of artificial hairs that can be placed underneath an individual's natural lashes.

For example, the multiple clusters could be connected together using a hot melt method substantially similar to the hot melt method used to form the individual clusters. As noted above, the hot melt method requires that the multiple clusters be heated to a temperature that is sufficient to cause the individual lashes to begin to melt. Thus, clusters made of PBT could be heated to approximately 55-110° C. (e.g., 65° C.) near one end. For example, the clusters could be heated approximately 1.5-2.5 mm above the base. As the individual artificial hairs begin to melt, the multiple clusters will connect to one another near the base to form a straight line of artificial hairs, thereby forming a lash fusion.

As another example, the multiple clusters could be connected together using a glue or some other adhesive composed of various substances. In such embodiments, the clusters may be exposed to a curing assembly (e.g., a heater, dryer, or light source) that causes the adhesive to solidify. Thus, after multiple clusters have been formed (e.g., via a hot melt process), the multiple clusters may be glued to one another to form a lash fusion. Artificial lashes made of natural materials (e.g., human or authentic mink hair) are typically connected using a glue or other adhesive rather than through the hot melt process.

An adhesive (e.g., a pressure-sensitive adhesive) can then be applied to the top of the lash fusion (step 803). The adhesive may enable an individual to subsequently apply the lash fusion directly to the underside of the individual's natural lashes. Additionally or alternatively, the individual could apply an adhesive before applying the lash fusion to the natural lashes.

In some embodiments, multiple lash fusion are positioned in a specified arrangement to form a set of lash extensions (step 804). For example, 4-6 lash fusions could be arranged such that the inner ends (i.e., the bases) of the lash fusions form a concave shape that substantially complements the tightline of an eyelid. While the lash fusions are typically not connected to one another (e.g., are not fused together using heat, an adhesive, etc.), the entire set could be applied to the underside of the individual's natural lashes in a single motion.

Figure 9:
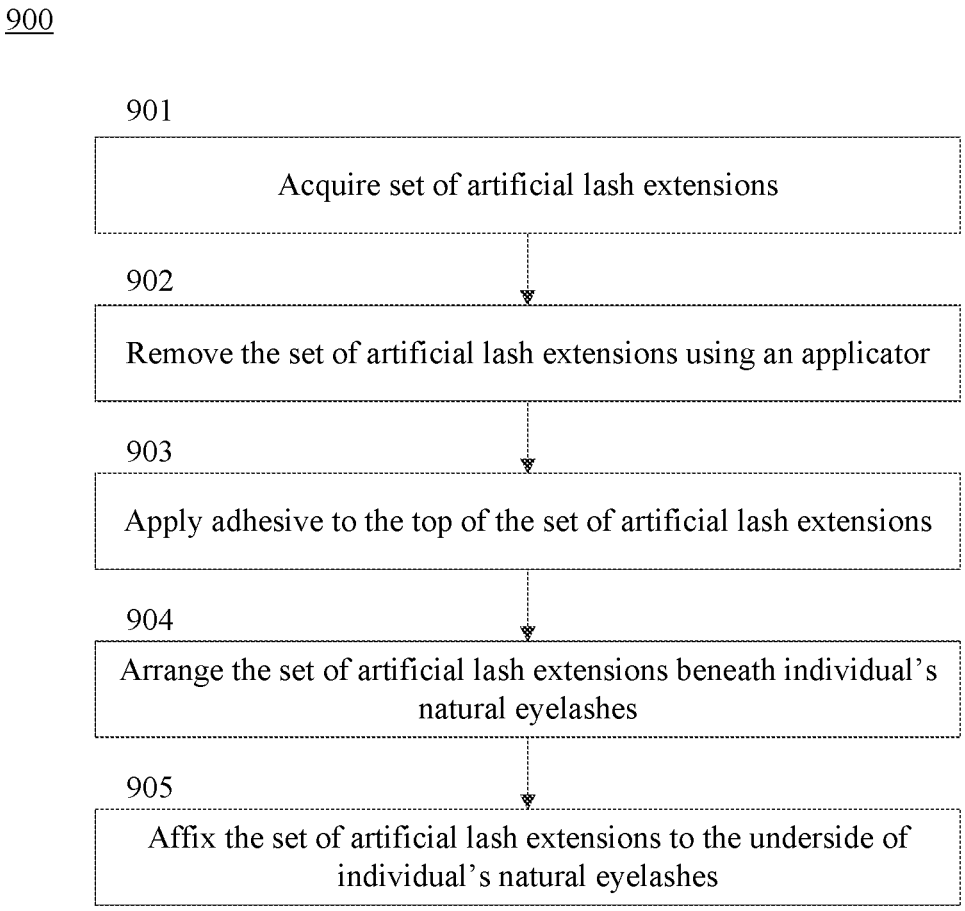
FIG. 9 depicts a flow diagram of a process for applying a set of lash extensions to an individual's natural eyelashes.

FIG. 9 depicts a flow diagram of a process 900 for applying a set of artificial lash extensions to an individual's natural lashes. The set of lash extensions is initially acquired by the individual or a healthcare professional, such as a lash technician or cosmetician (step 901). The set of artificial lash extensions can include multiple lash fusions, each of which is comprised of multiple clusters of artificial lashes. The set of artificial lash extensions can then be grasped using an applicator (step 902). The applicator may be designed so that the entire set of artificial lash extensions (i.e., all of the lash fusions) can be seized and removed (e.g., from a surface to which the set of artificial lash extensions are attached) in a single motion.

In some embodiments an adhesive is applied to the top of each lash fusion in the set of artificial lash extensions (step 903), while in other embodiments an adhesive is applied to the top of each lash fusion in the set of artificial lash extensions during the manufacturing process. The adhesive could be, for example, a waterproof glue or mascara. The set of artificial lash extensions can then be arranged proximate to the tightline beneath the individual's natural lashes (step 904) and affixed to the underside of the individual's natural lashes (step 905), rather than to the individual's eyelid above the lash line.

Unless contrary to physical possibility, it is envisioned that the steps described above may be performed in various sequences and combinations. For instance, an adhesive could be applied to the individual clusters before or after the clusters are formed into lash fusions. Other steps could also be included in some embodiments.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

What is claimed is:

1. An artificial lash extension system comprising:

a plurality of lash extensions, each of the plurality of lash extensions comprising:

a plurality of clusters of artificial hairs, each of the plurality of clusters comprising at least two artificial hairs; and a base, wherein the plurality of clusters are attached to the base by at least an application of heat, wherein the at least two artificial hairs of each of the plurality of clusters protrude from the base, wherein at least some of the artificial hairs of at least one of the plurality of clusters are coupled to one another at a respective part of the base, and wherein the base is designed to at least attach the lash extension to an underside of natural lashes.

2. The artificial lash extension system of claim 1, wherein the at least two artificial hairs comprise a synthetic material.

3. The artificial lash extension system of claim 2, wherein the at least two artificial hairs comprise polybutylene terephthalate (PBT).

4. The artificial lash extension system of claim 2, wherein the at least two artificial hairs comprise polyester.

5. The artificial lash extension system of claim 1, wherein at least a portion of each of the plurality of clusters is fused to the base by the application of heat.

6. The artificial lash extension system of claim 5, wherein the base is formed by at least the application of heat.

7. The artificial lash extension system of claim 6, wherein the plurality of clusters are connected together by at least the application of heat.

8. The artificial lash extension system of claim 1, wherein the plurality of lash extensions are designed for an application under the natural lashes in an arrangement adjacent to one another under the natural lashes.

9. The artificial lash extension system of claim 1, wherein one or more of the at least two artificial hairs of a first cluster of the plurality of clusters crisscross one or more of the at least two artificial hairs of a second cluster of the plurality of clusters.

10. The artificial lash extension system of claim 1, wherein an artificial hair of a first cluster of the plurality of clusters crisscrosses another artificial hair of the first cluster.

11. The artificial lash extension system of claim 1, wherein the application of heat facilitates at least a partial melting of one or more of the plurality of clusters.

12. The artificial lash extension system of claim 1, wherein the application of heat comprises heat sealing.

13. The artificial lash extension system of claim 1, wherein the application of heat comprises heat fusing.

14. The artificial lash extension system of claim 1, wherein each of the plurality of lash extensions is further formed by an application of an adhesive.

15. The artificial lash extension system of claim 14, wherein the plurality of clusters are connected together by at least the application of the adhesive.

16. The artificial lash extension system of claim 1, wherein the plurality of lash extensions are designed for an application under the natural lashes proximate to a lash line.

17. The artificial lash extension system of claim 1, wherein a thickness of the base ranges between 0.05 millimeters (mm) and 0.15 mm inclusive.

18. The artificial lash extension system of claim 1, wherein a thickness of the base is less than 0.3 millimeters.

19. An artificial lash extension system, comprising:

a container; and a plurality of lash extensions releasably coupled to the container, each of the plurality of lash extensions comprising:

a plurality of clusters of artificial hairs, each of the plurality of clusters comprising at least two artificial hairs; and a base, wherein the plurality of clusters are attached to the base by at least an application of heat, wherein the at least two artificial hairs of each of the plurality of clusters protrude from the base, wherein at least some of the artificial hairs of at least one of the plurality of clusters are coupled to one another at a respective part of the base, and wherein the base is designed to at least attach to an underside of natural lashes.

20. The artificial lash extension system of claim 19, wherein the at least two artificial hairs comprise a synthetic material.

21. The artificial lash extension system of claim 20, wherein the at least two artificial hairs comprise polybutylene terephthalate (PBT).

22. The artificial lash extension system of claim 20, wherein the at least two artificial hairs comprise polyester.

23. The artificial lash extension system of claim 19, wherein at least a portion of each of the plurality of clusters is fused to the base by at least the application of heat.

24. The artificial lash extension system of claim 23, wherein the base is formed by at least the application of heat.

25. The artificial lash extension system of claim 24, wherein the plurality of clusters are connected together by at least the application of heat.

26. The artificial lash extension system of claim 19, wherein the plurality of lash extensions are designed for an application under the natural lashes in an arrangement adjacent to one another under the natural lashes.

27. The artificial lash extension system of claim 19, wherein one or more of the at least two artificial hairs of a first cluster of the plurality of clusters crisscross one or more of the at least two artificial hairs of a second cluster of the plurality of clusters.

28. The artificial lash extension system of claim 19, wherein an artificial hair of a first cluster of the plurality of clusters crisscrosses another artificial hair of the first cluster.

29. The artificial lash extension system of claim 19, wherein the application of heat facilitates at least a partial melting of one or more of the plurality of clusters.

30. The artificial lash extension system of claim 19, wherein the application of heat comprises heat sealing.

31. The artificial lash extension system of claim 19, wherein the application of heat comprises heat fusing.

32. The artificial lash extension system of claim 19, wherein each of the plurality of lash extensions is further formed by an application of an adhesive.

33. The artificial lash extension system of claim 32, wherein the plurality of clusters are connected together by at least the application of the adhesive.

34. The artificial lash extension system of claim 19, wherein the plurality of lash extensions are designed for an application under the natural lashes proximate to a lash line.

35. The artificial lash extension system of claim 19, wherein a thickness of the base ranges between 0.05 millimeters (mm) and 0.15 mm inclusive.

36. The artificial lash extension system of claim 19, wherein a thickness of the base is less than 0.3 millimeters.

* * * * *